US012082626B2

(12) United States Patent
Agou

(10) Patent No.: US 12,082,626 B2
(45) Date of Patent: Sep. 10, 2024

(54) UNDERWEAR FOR MEN

(71) Applicant: Delta Galil Industries Ltd., Caesarea (IL)

(72) Inventor: Diana Agou, Karmiel (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 68 days.

(21) Appl. No.: 17/413,968

(22) PCT Filed: Mar. 5, 2020

(86) PCT No.: PCT/IL2020/050259
§ 371 (c)(1),
(2) Date: Jun. 15, 2021

(87) PCT Pub. No.: WO2020/178836
PCT Pub. Date: Sep. 10, 2020

(65) Prior Publication Data

US 2022/0039483 A1 Feb. 10, 2022

Related U.S. Application Data

(60) Provisional application No. 62/814,863, filed on Mar. 7, 2019.

(51) Int. Cl.
*A41B 9/00* (2006.01)
*A41B 9/02* (2006.01)

(52) U.S. Cl.
CPC ..... *A41B 9/023* (2013.01)

(58) Field of Classification Search
CPC ..... A42B 9/02; A42B 9/023
See application file for complete search history.

(56) References Cited

U.S. PATENT DOCUMENTS 2,145,688 A * 1/1939 Flamberg ..... A41B 9/02 2/401
2,249,198 A * 7/1941 Carter ..... A41B 9/02 66/190

(Continued)

FOREIGN PATENT DOCUMENTS

CN 2566647 Y 8/2003
CN 202949979 U 5/2013
TW 200800051 A 1/2018

OTHER PUBLICATIONS

International Search Report in PCT/IL2020/050259, dated May 19, 2020.

(Continued)

*Primary Examiner* — Richale L Quinn
(74) *Attorney, Agent, or Firm* — AlphaPatent Associates Ltd.; Daniel J. Swirsky

(57) ABSTRACT

An underwear for men includes: a front-side pouch to accommodate therein genitalia of a human wearer; and a gusset element to cover at least an anus area of the human wearer; wherein the front-side pouch and the gusset element are implemented as a unified pouch-and-gusset member, which is a single, monolithic, seam-less, continuous fabric. The unified pouch-and-gusset member lacks any seams between the front-side pouch and the gusset element. The unified pouch-and-gusset member further includes an excess piece of fabric that holds together the front-side pouch and the gusset element; wherein (i) the excess piece of fabric and (ii) the front-side pouch and (iii) the gusset element are implemented as a unified, single, monolithic, seam-less, continuous fabric. The underwear conveniently prevents rubbing of a penis of the human wearer against the testicles or hips of the human wearer, or conveniently prevents other types of inter-organ rubbing.

4 Claims, 6 Drawing Sheets

(56) References Cited

U.S. PATENT DOCUMENTS

| | | | | | |
|---|---|---|---|---|---|
| 2,519,534 | A * | 8/1950 | Artzt | D04B 1/246 | 66/175 |
| 2,623,210 | A * | 12/1952 | Chatfield | D04B 1/18 | 2/403 |
| 2,624,336 | A * | 1/1953 | Hansley | A61F 5/40 | 2/404 |
| 2,641,258 | A * | 6/1953 | Rutledge | A41B 9/02 | 450/104 |
| 2,997,044 | A * | 8/1961 | Simons | A41B 9/02 | 2/403 |
| 3,517,666 | A * | 6/1970 | Atlee | A41B 9/02 | 2/403 |
| 4,759,355 | A * | 7/1988 | Thrower | A41B 9/023 | 2/405 |
| 5,094,234 | A * | 3/1992 | Searcy | A61F 5/40 | 602/73 |
| 7,774,865 | B2 * | 8/2010 | Miller | A41D 1/089 | 2/403 |
| 8,332,968 | B1 * | 12/2012 | Williams | A41B 9/02 | 2/403 |
| 9,149,076 | B2 | 10/2015 | Almog | | |
| 11,553,737 | B1 * | 1/2023 | Hong | A41B 9/023 | |
| 2005/0229293 | A1 * | 10/2005 | Miller | A41D 1/089 | 2/403 |
| 2008/0178369 | A1 * | 7/2008 | Kitsch | A41B 9/023 | 2/405 |
| 2010/0005561 | A1 * | 1/2010 | Holland | A41B 9/023 | 2/403 |
| 2017/0238618 | A1 * | 8/2017 | Blibech | A41B 9/14 | |
| 2017/0258144 | A1 * | 9/2017 | Bardini | A41D 13/0556 | |
| 2022/0015460 | A1 * | 1/2022 | Lam | A41B 9/02 | |
| 2023/0043323 | A1 * | 2/2023 | Vitarana | A41B 9/14 | |

OTHER PUBLICATIONS

Written Opinion of the International Searching Authority in PCT/IL2020/050259, dated May 19, 2020.

Machine Translation of CN 2566647 Y Obtained on Aug. 30, 2021 from Google Patents: https://patents.google.com/patent/CN2566647Y/en.

Machine Translation of CN 202949979 U Obtained on Aug. 30, 2021 from Google Patents: https://patents.google.com/patent/CN202949979U/en.

Machine Translation of TW 200800051 A Obtained on Aug. 30, 2021 from Google Patents: https://patents.google.com/patent/TW200800051A/en.

Communication from the European Patent Office in patent application EP 20766327.9, dated Oct. 21, 2022.

Communication from the European Patent Office in European patent application EP 20766327.9, dated Dec. 13, 2023.

Communication from the European Patent Office in European patent application EP 20766327.9, dated Oct. 21, 2022.

Communication from the Israel Patent Office in Israeli patent application IL 283887, dated Dec. 24, 2023.

* cited by examiner

UNDERWEAR FOR MEN

CROSS-REFERENCE TO RELATED APPLICATIONS

This patent application is a National Stage of PCT international application number PCT/IL2020/050259, having an international filing date of Mar. 5, 2020, published as international publication number WO 2020/178836 A1, which is hereby incorporated by reference in its entirety; which claims priority and benefit from U.S. 62/814,863, filed on Mar. 7, 2019, which is hereby incorporated by reference in its entirety.

FIELD

The present invention is related to the field of clothing.

BACKGROUND

Clothing articles and clothes are typically formed of textile material and are worn on the body. Clothes are worn for various purposes, for example, to keep the human body warm in a cold weather, to protect the human body from rough surfaces or insects or plants, to provide a hygienic barrier between the human body and the environment, to protect the human body from ultraviolet radiation, to cover genitals, for social reasons or as fashion, or the like.

SUMMARY

Some embodiments of the present invention may comprise garments or undergarments for men, such as underwear or swimwear, having a front-side pouch or pocket that operates as a housing to securely hold and maintain in place the penis and testicles of the wearer, and/or to prevent them from moving around within the undergarment, and/or to prevent them from rubbing against the hip(s) or the inner side of the hip(s) of the wearer.

For example, an underwear for men includes: a front-side pouch to accommodate therein genitalia of a human wearer; and a gusset element to cover at least an anus area of the human wearer; wherein the front-side pouch and the gusset element are implemented as a unified pouch-and-gusset member, which is a single, monolithic, seam-less, continuous fabric. The unified pouch-and-gusset member lacks any seams between the front-side pouch and the gusset element. The unified pouch-and-gusset member further includes an excess piece of fabric that holds together the front-side pouch and the gusset element; wherein (i) the excess piece of fabric and (ii) the front-side pouch and (iii) the gusset element are implemented as a unified, single, monolithic, seam-less, continuous fabric. The underwear conveniently prevents rubbing of a penis of the human wearer against the testicles or hips of the human wearer, or conveniently prevents other types of inter-organ rubbing.

The present invention may provide other and/or additional advantages and/or benefits.

DETAILED DESCRIPTION OF SOME DEMONSTRATIVE EMBODIMENTS OF THE INVENTION

The Applicants have realized that some conventional underwear for men are too loose, and allow the genitalia of the wearer to move within the underwear and/or to rub against the inner side of the hip(s) of the wearer.

The Applicants have also realized that some other conventional underwear for men are too tight, and attempt to hold the genitalia in place simply by providing an underwear that is small in size and tight, thereby "squeezing" the genitalia or even hurting it or causing discomfort or inconvenience to the wearer.

The present invention provides a garment or an undergarment for men, particularly underwear or swimwear, that comprises a front-side pouch or pocket that securely holds in place the wearer's genitalia (penis and testicles), and/or prevents the genitalia from rubbing against (or touching) the inner side of the hip(s) of the wearer, while also providing a generally non-tight and non-squeezing feeling to the wearer.

Figure 1A:
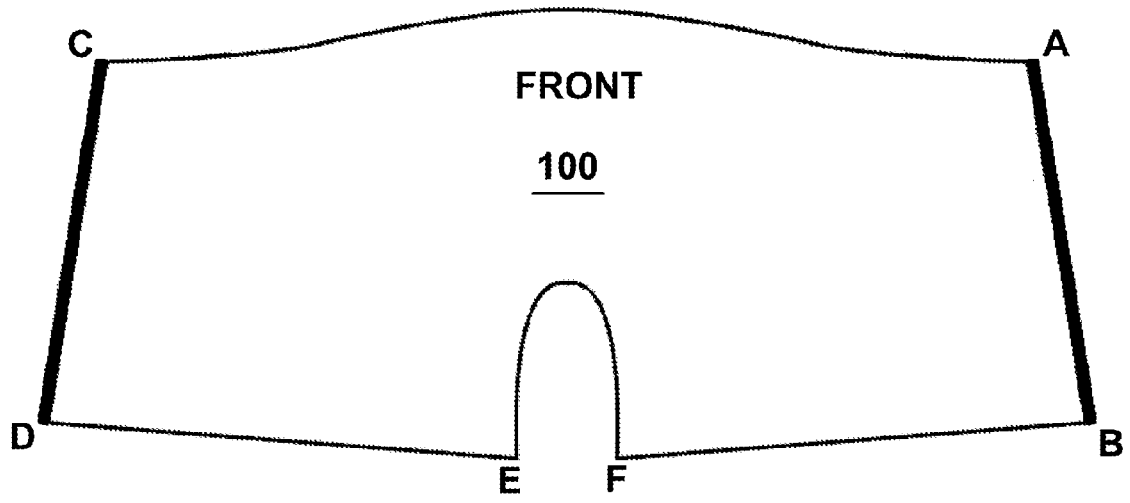
FIG. 1A is a schematic illustration of a front view of an underwear (e.g., when being laid down flat on a surface with the front side facing up), in accordance with some demonstrative embodiments of the present invention.
Figure 1B:
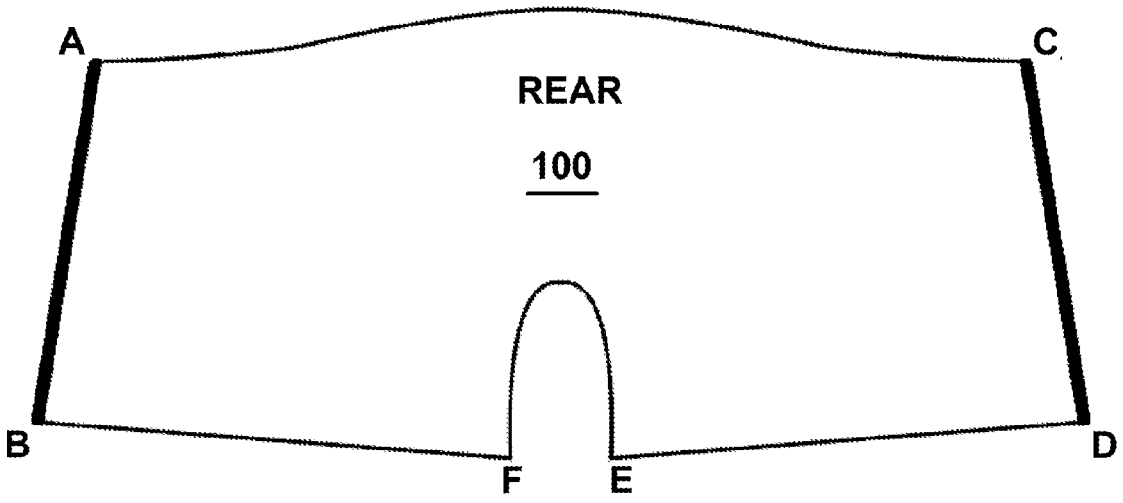
FIG. 1B is a schematic illustration of a rear view of the underwear (e.g., when being laid down flat on a surface with the rear side facing up), in accordance with some demonstrative embodiments of the present invention.

Reference is made to FIG. 1A, which is a schematic illustration of a front view of an underwear 100 (e.g., when being laid down flat on a surface with the front side facing up), in accordance with some demonstrative embodiments of the present invention; and to FIG. 1B, which is a schematic illustration of a rear view of underwear 100 (e.g., when being laid down flat on a surface with the rear side facing up), in accordance with some demonstrative embodiments of the present invention.

In accordance with the present invention, the undergarment for men includes a waistband (e.g., elastic waistband) that encircles the waist area of the wearer; such as, shown via the curved line that connects Point A and Point B. The waistband is connected to (i) a front-side fabric that covers the front-side of the wearer's body (e.g., covers the genitalia and also covers at least some of the top-portions of the right hip and the left hip of the wearer), and to (ii) a rear-side fabric that covers the buttocks of the wearer.

The front side and the rear side of the underwear are connected, beneath the genitalia and beneath the anus of the wearer, via a crotch panel or a gusset, while leaving two circular or oval holes or orifices through which the legs of the wearer enter (during the wearing operation of the undergarment) and exit (during taking-off operation of the undergarment).

The front side of the underwear comprises an integral or integrated or embedded pouch or pocket, which accommodates and holds therein the wearer's genitalia (penis and testicles). The pocket or pouch comprises, for example, a right-side fabric panel and a left-side fabric panel, that are connected in a manner that encloses the genitalia from the right and from the left, and which prevents the genitalia from moving at all, or prevents the genitalia (or at least some of the genitalia) from rubbing against the hips of the wearer, or that makes it more difficult for the genitalia of the wearer to move within the undergarment and/or to directly touch the hips of the wearer.

In accordance with the present invention, there is a joint between the pouch and the gusset, thereby creating a unique structure that is advantageous to the male wearer, and separates the testicles from the legs or hips, and/or prevents or reduces friction and/or sweating, and/or maintains the testicles non-moving in their place. Parts of the pouch and the gusset are directly connected to each other as a single piece (e.g., via internal and/or external seam; or via a seamless connection, such as gluing, welding, ultrasonic welding, melting yarns, or the like); and excess fabric is provided to allow space or room for the testicles.

The side contour or the side edge of the pouch or pocket, is straight or linear or non-curved, in contrast with other structures that some conventional underwear may utilize; as the Applicants have realized that straight or linear or non-curved side contour of the pouch or pocket provides (or contributes to) the desired immobilization of the genitalia. This particular structure enables the fabric, on the sides of the pouch or pocket, to cling or to hold to the body of the wearer, thereby preventing the undergarment (or at least portions thereof) from being all loose, and/or thereby providing the tailored fit of the undergarment.

One or more of the edges of the pouch, or all of the edges of the pouch, may optionally comprise or may be connected to excess fabric strip(s) and/or excess fabric portions, which may provide and/or improve the spatial separation between the genitalia and the hips or legs of the wearer.

Figure 2A:
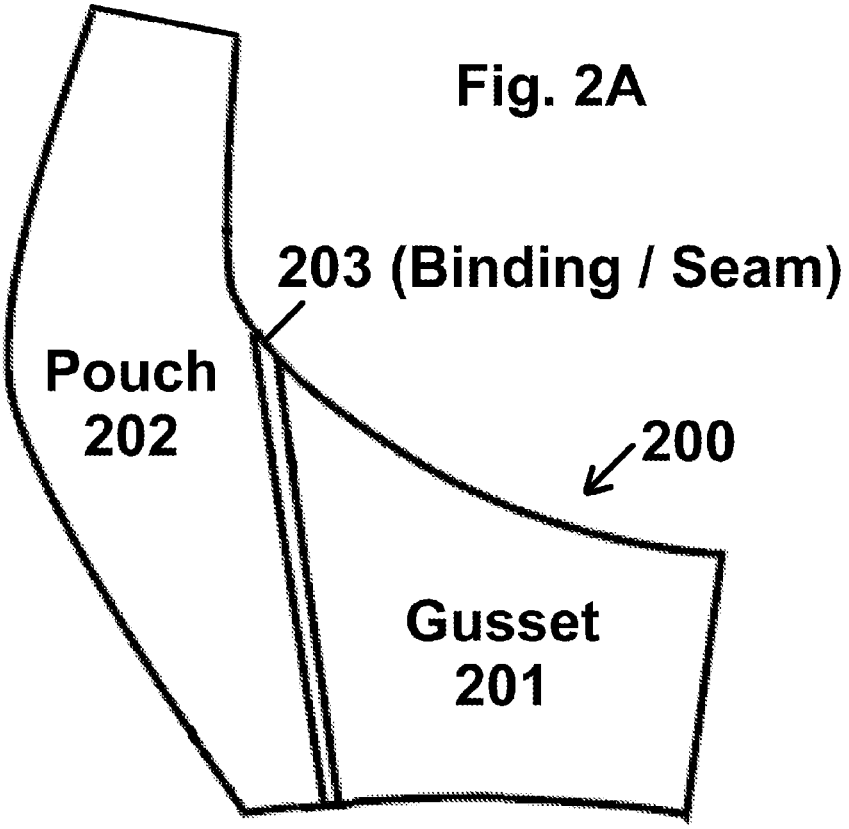
FIG. 2A is a side-view of a portion of an underwear, in accordance with some implementations.

Reference is made to FIG. 2A, which is a side-view of a portion 200 of an underwear, in accordance with some implementations. Gusset region 201 and pouch region 202 are two distinct regions of the underwear, each one of them being produced separately; and they are then connected to each other via a binding/seam 203. This may cause inconvenience to some human wearer, due to the binding or seam that connects the gusset region 201 with the pouch region 202.

Figure 2B:
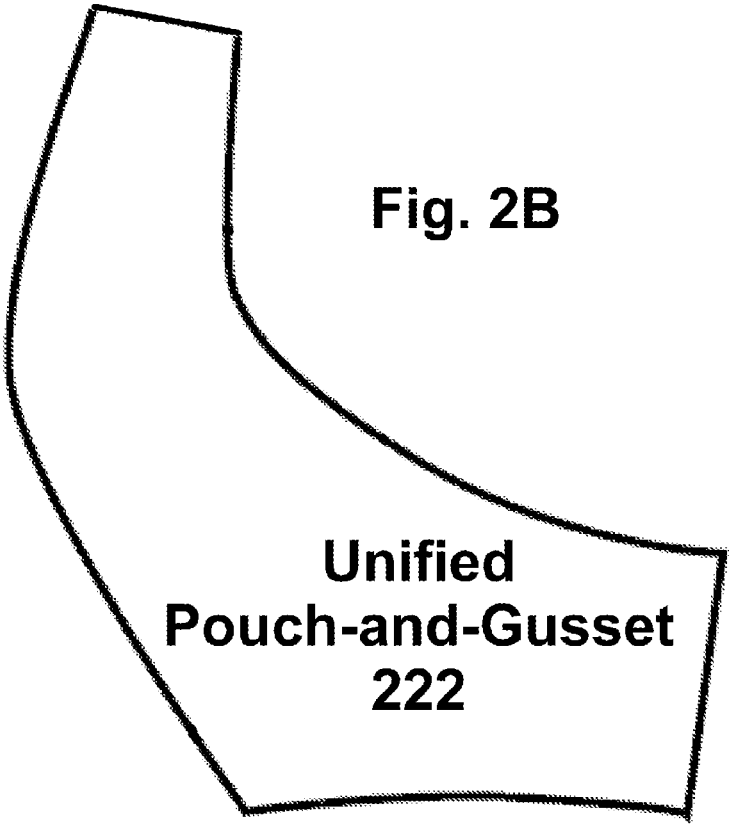
FIG. 2B is a side-view of a portion of an underwear, in accordance with some demonstrative embodiments of the present invention.

Reference is made to FIG. 2B, which is a side-view of a portion 222 of an underwear, in accordance with some demonstrative embodiments of the present invention. It shows a unified pouch-and-gusset region 222, which is a single, unified, pouch-and-gusset member or pouch-and-gusset element, that is seam-less, and lacks seam(s) or binding strips or binding layer(s) that connect a gusset region with a pouch region; but rather, provide a seam-less and continuous fabric that includes the entirety of the pouch-and-gusset region 202, having a monolithic structure or an un-divided structure of the front-side pouch and the gusset (or crotch area).

Figure 2C:
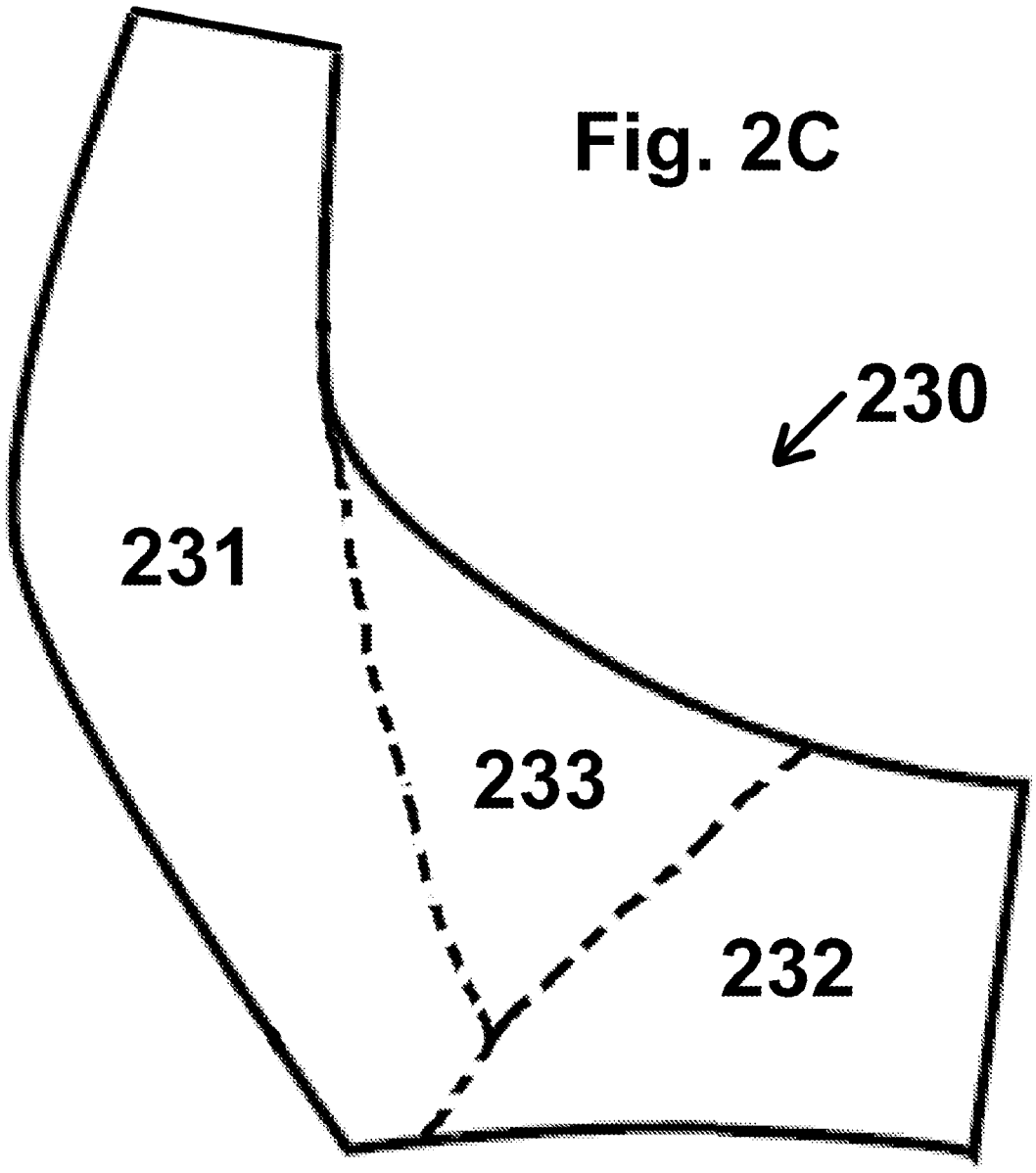
FIG. 2C is a side-view of a portion of an underwear, in accordance with some demonstrative embodiments of the present invention.

Reference is made to FIG. 2C, which is a side-view of a portion of an underwear, in accordance with some demonstrative embodiments of the present invention. It shows a unified pouch-and-gusset unit 230, which is a single, unified, pouch-and-gusset member or pouch-and-gusset element, that is seam-less, and lacks seam(s) or binding strips or binding layer(s) that connect a gusset region with a pouch region; but rather, provides a seam-less and continuous fabric that includes the entirety of the pouch-and-gusset region, having a monolithic structure or an un-divided structure of the front-side pouch 231 and the gusset 232 (or crotch area) as well as a region of excess fabric 233 which is a holding fabric that holds together the front-side pouch and the gusset. It is noted that the broken lines shown in this drawing are not seams and are not binding lines; but rather, they are only shown for illustrative purposes and do not exist in the actual underwear or in the actual pouch-and-gusset unit 230, in order to illustrate the three sub-regions (231, 232, 233) of this unified monolithic continuous-fabric pouch-and-gusset unit 230.

Figure 2D:
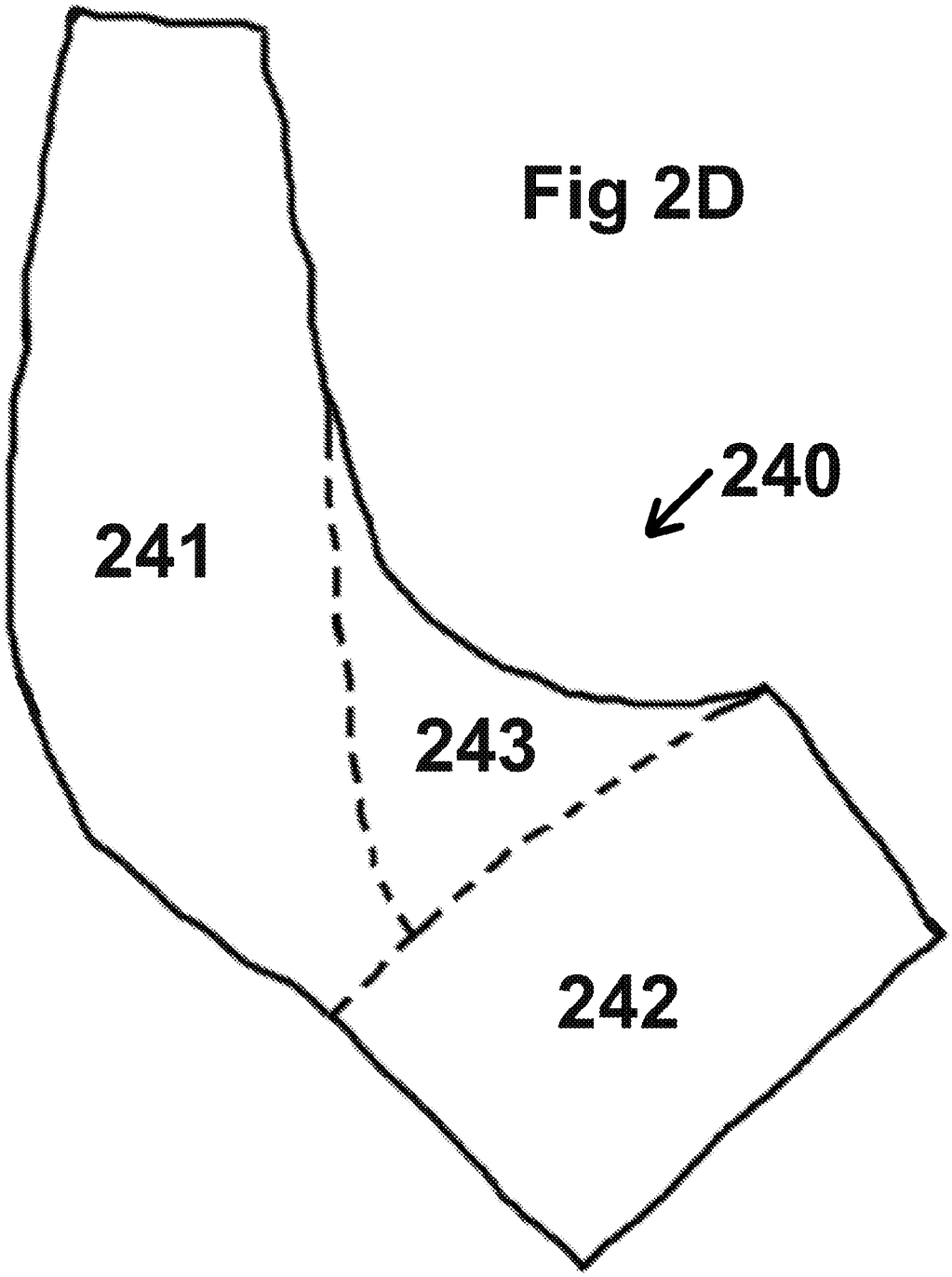
FIG. 2D is a side-view of a portion of an underwear, in accordance with some demonstrative embodiments of the present invention.

Reference is made to FIG. 2D, which is a side-view of a portion of an underwear, in accordance with some demonstrative embodiments of the present invention. It shows a unified pouch-and-gusset unit 240, which is a single, unified, pouch-and-gusset member or pouch-and-gusset element, that is seam-less, and lacks seam(s) or binding strips or binding layer(s) that connect a gusset region with a pouch region; but rather, provides a seam-less and continuous fabric that includes the entirety of the pouch-and-gusset region, having a monolithic structure or an un-divided structure of the front-side pouch 241 and the gusset 242 (or crotch area) as well as a region of excess fabric 243 which is a holding fabric that holds together the front-side pouch and the gusset. It is noted that the broken lines shown in this drawing are not seams and are not binding lines; but rather, they are only shown for illustrative purposes and do not exist in the actual underwear or in the actual pouch-and-gusset unit 240, in order to illustrate the three sub-regions (241, 242, 243) of this unified monolithic continuous-fabric pouch-and-gusset unit 230.

Figure 2E:
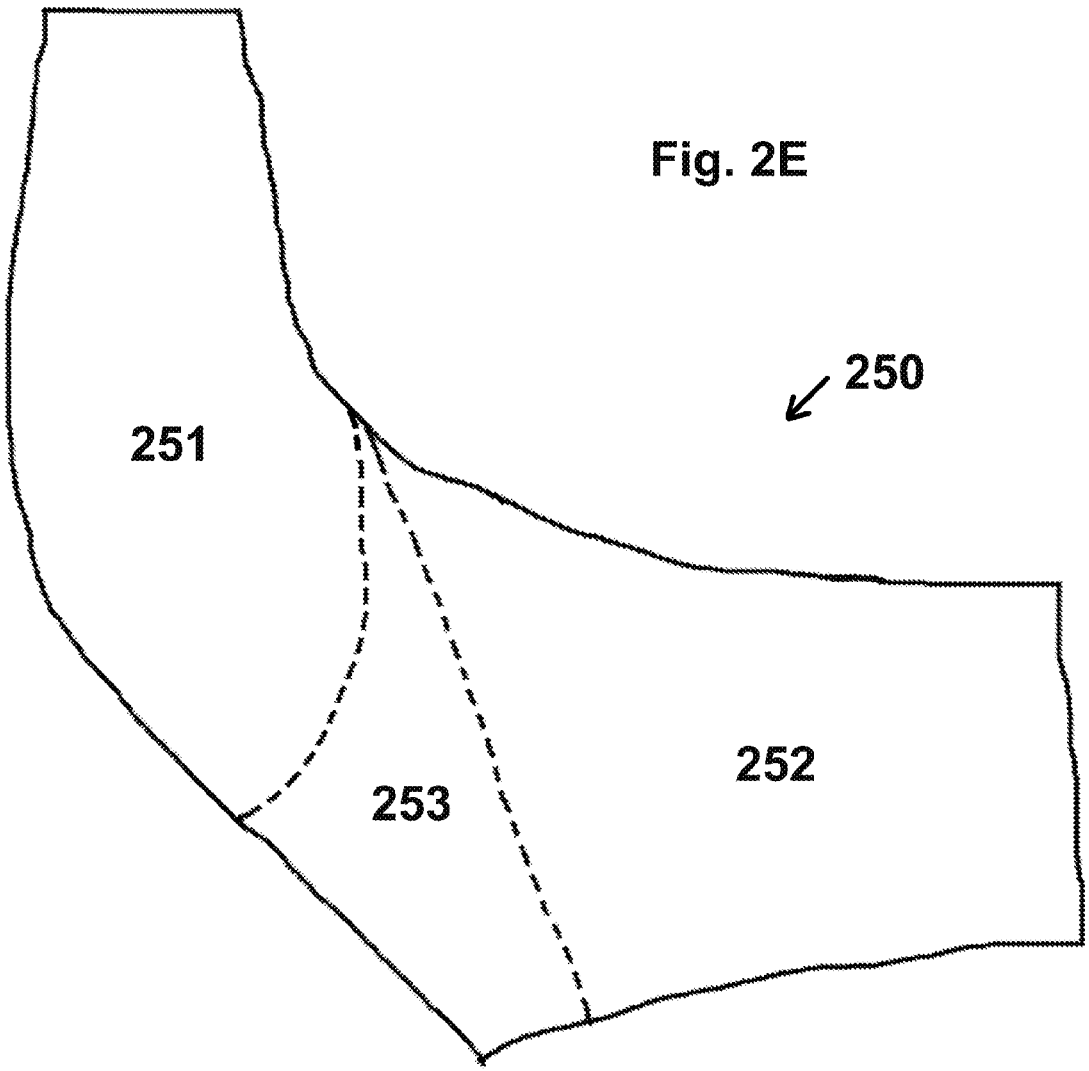
FIG. 2E is a side-view of a portion of an underwear, in accordance with some demonstrative embodiments of the present invention.

Reference is made to FIG. 2E, which is a side-view of a portion of an underwear, in accordance with some demonstrative embodiments of the present invention. It shows a unified pouch-and-gusset unit 250, which is a single, unified, pouch-and-gusset member or pouch-and-gusset element, that is seam-less, and lacks seam(s) or binding strips or binding layer(s) that connect a gusset region with a pouch region; but rather, provides a seam-less and continuous fabric that includes the entirety of the pouch-and-gusset region, having a monolithic structure or an un-divided structure of the front-side pouch 251 and the gusset 252 (or crotch area) as well as a region of excess fabric 253 which is a holding fabric that holds together the front-side pouch and the gusset. It is noted that the broken lines shown in this drawing are not seams and are not binding lines; but rather, they are only shown for illustrative purposes and do not exist in the actual underwear or in the actual pouch-and-gusset unit 250, in order to illustrate the three sub-regions (251, 252, 253) of this unified monolithic continuous-fabric pouch-and-gusset unit 250.

Figure 3:
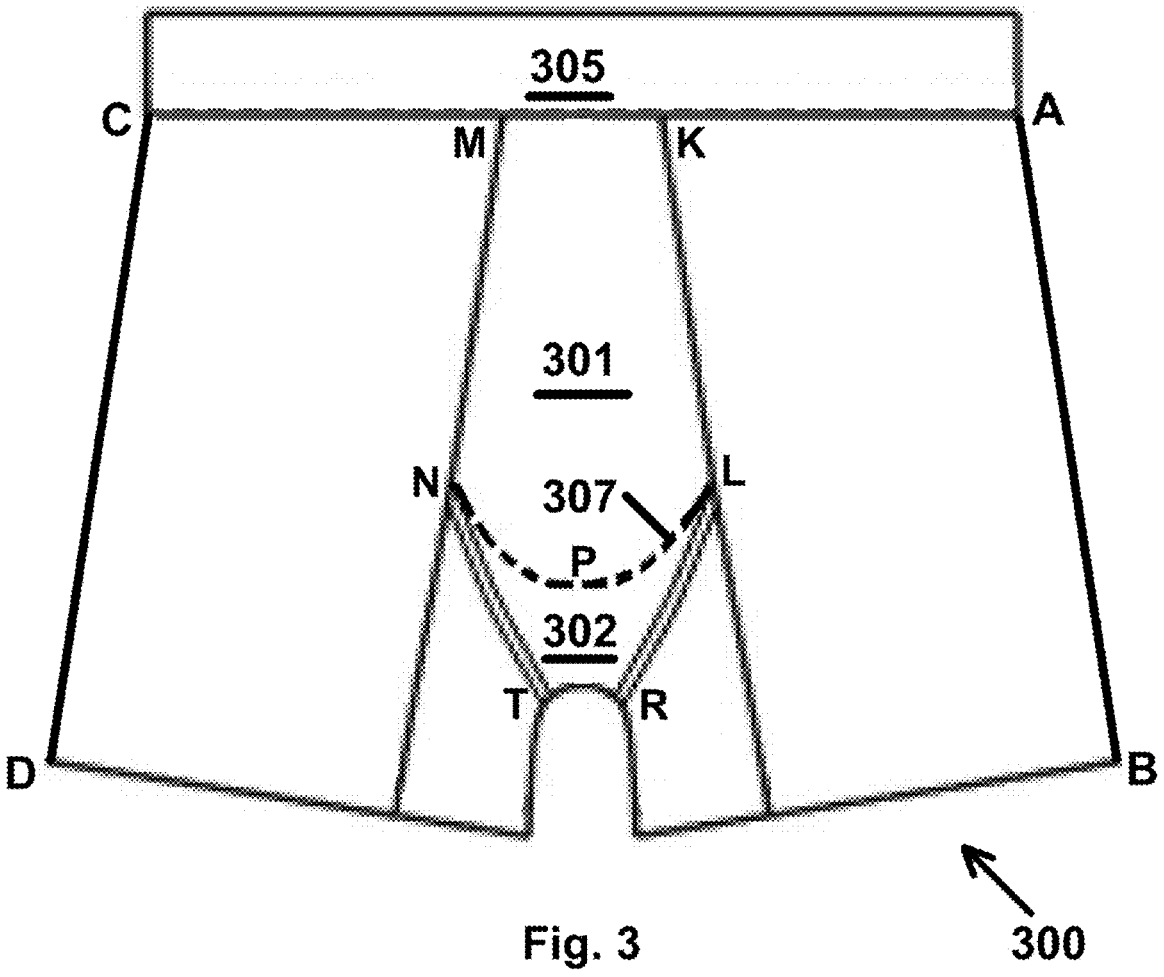
FIG. 3 is a schematic illustration of a front view of an underwear (e.g., when being laid down flat on a surface with the front side facing up), in accordance with some demonstrative embodiments of the present invention.

Reference is made to FIG. 3, which is a schematic illustration of a front view of an underwear 300 (e.g., when being laid down flat on a surface with the front side facing up), in accordance with some demonstrative embodiments of the present invention. Waist-band 305 is shown at the top. Each one of the right-side edge and the left-side edge (e.g., Line A-B, and Line C-D) is a straight line, rather than being curved. A front-side pouch 301 and a gusset 302 are a unified unit formed of a continuous and singular piece of seam-less and connection-less fabric, such that the illustrative line denoted with reference numeral 307 does not appear in the actual underwear 300 and is not a seam and is not a connection strip or a connection element.

The present invention further comprises a method or process, which may be computer-assisted or machine-assisted, or may be implemented via machines and/or manufacturing equipment (e.g., sewing machine, cutting machine, machine-controlled needles or cutters, robotic arms, conveyor belts, or the like). The method may comprise, for example: producing or making or manufacturing a garment or undergarment or underwear or swimwear for men, by creating a front-side fabric pouch that is directly connected to the gusset or crotch area of the underwear, and by providing and creating excess fabric that borders at least one of (i) the pouch and/or (ii) the gusset or crotch area, such that the pouch and/or the excess fabric separates the testicles and/or the penis of the wearer from touching (or rubbing) the hips or the legs of the wearer.

For demonstrative purposes, some portions of the discussion herein may relate to an underwear; however, the present invention may similarly comprise other types of garments and/or undergarments that may have similar properties as the described underwear; for example, swimwear, swimsuit, shorts, athletic wear, sports-wear, boxers, briefs, knitted boxers, knitted briefs, thongs, cycling shorts, fitness shorts, shorts used by athletes, or the like.

In some embodiments, the front-side pouch is pear shaped; in other embodiments, the front-side pouch is non-pear-shaped, or is circular or oval or elliptical, or is egg-shaped, or is shaped as American football or rugby ball, or has vertical symmetry but not horizontal symmetry, or has vertical symmetry and also horizontal symmetry, or has horizontal symmetry but not vertical symmetry, or lacks horizontal symmetry and also lacks vertical symmetry.

In some embodiments, an underwear for men comprises: a front-side pouch to accommodate therein genitalia of a male human wearer; a gusset element to cover at least an anus area of the male human wearer; wherein the front-side pouch and the gusset element are implemented as a unified pouch-and-gusset member which is a single, monolithic, seam-less, continuous fabric.

In some embodiments, the unified pouch-and-gusset member lacks any seams between the front-side pouch and the gusset element.

In some embodiments, the unified pouch-and-gusset member further comprises an excess piece of fabric that holds together the front-side pouch and the gusset element; wherein (i) the excess piece of fabric and (ii) the front-side pouch and (iii) the gusset element are implemented as a unified, single, monolithic, seam-less, continuous fabric.

In some embodiments, the unified pouch-and-gusset member further comprises an excess piece of fabric that is generally triangular and that holds together the front-side pouch and the gusset element; wherein (i) the excess piece of fabric and (ii) the front-side pouch and (iii) the gusset element are implemented as a unified, single, monolithic, seam-less, continuous fabric.

In some embodiments, the unified pouch-and-gusset member further comprises an excess piece of fabric that is generally trapezoid and that holds together the front-side pouch and the gusset element; wherein (i) the excess piece of fabric and (ii) the front-side pouch and (iii) the gusset element are implemented as a unified, single, monolithic, seam-less, continuous fabric.

In some embodiments, a right-side contour edge of said underwear is straight and non-curved; wherein a left-side contour edge of said underwear is straight and non-curved.

In some embodiments, the front-side pouch is structured to accommodate therein only a penis of the male human wearer and not any testicle of the male human wearer.

In some embodiments, the front-side pouch is structured to accommodate therein both (i) a penis of the male human wearer and (ii) at least one testicle of the male human wearer.

In some embodiments, the front-side pouch is structured to accommodate therein both (i) a penis of the male human wearer and (ii) two testicles of the male human wearer.

In some embodiments, the front-side pouch prevents rubbing of (i) a penis of the male human wearer, against (ii) a hip of the male human wearer.

In some embodiments, the front-side pouch prevents rubbing of (i) a penis of the male human wearer, against (ii) a testicle of the male human wearer.

In some embodiments, the front-side pouch prevents rubbing of (i) a testicle of the male human wearer, against (ii) a hip of the male human wearer.

In some embodiments, the front-side pouch lifts upwardly, and holds in place, a penis of the male human wearer and prevents the penis from rubbing against hips of the male human wearer.

In some embodiments, the front-side pouch lifts upwardly, and holds in place, a penis of the male human wearer and prevents the penis from rubbing against testicles of the male human wearer.

In some embodiments, exactly one edge of the front-side pouch, and exactly one edge of the gusset element, are each integrally connected to an excess piece of fabric that holds together the front-side pouch and the gusset element.

In some embodiments, one or more edges of the front-side pouch, and one or more edges of the gusset element, are integrally connected to an excess piece of fabric that holds together the front-side pouch and the gusset element.

In some embodiments, the front-side pouch is generally pear-shaped.

In some embodiments, the front-side pouch is generally non-pear-shaped.

In some embodiments, the front-side pouch is generally oval.

In some embodiments, the front-side pouch has both horizontal symmetry and vertical symmetry.

In some embodiments, the front-side pouch has horizontal symmetry but not vertical symmetry.

In some embodiments, the front-side pouch has vertical symmetry but not horizontal symmetry.

In some embodiments, the front-side pouch has at least one of: horizontal a-symmetry, vertical a-symmetry.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A boxers underwear (100) for men, comprising:

a front-side pouch (231) to accommodate therein genitalia of a male human wearer;

a gusset element (232) to cover at least an anus area of the male human wearer;

a holding piece-of-fabric (233, 243), having a first edge that borders the front-side pouch (231), and having a second edge that borders the gusset element (232);

wherein the holding piece-of-fabric (233, 243) is triangular, and holds together the front-side pouch (231) and the gusset element (232);

wherein the front-side pouch (231) and the gusset element (232) and the holding piece-of-fabric (233, 243) are a unified pouch-and-gusset member which is a single, monolithic, seam-less, continuous fabric, lacking any seams between the front-side pouch (231) and the gusset element (232), and lacking any seams between the front-side pouch (231) and the holding piece-of-fabric (233, 243), and lacking any seams between the gusset element (232) and the holding piece-of-fabric (233, 243);

wherein the front-side pouch (231) is structured to have a curved bottom-region (N-P-L), that is connected to (i) a right-side inwardly-slanted straight panel (M-N) of the front-side pouch (231) and also to (ii) a left-side inwardly-slanted straight panel (K-L) of the front-side pouch (231), wherein the right-side inwardly-slanted straight panel (M-N) of the front-side pouch (231) and the left-side inwardly-slanted straight panel (K-L)_of the front-side pouch (231) are non-parallel to each other, and wherein an entirety of side contours of the front-side pouch (231) is an entirely straight and entirely non-curved side contour that comprises said right-side inwardly-slanted straight panel (M-N) and said left-side inwardly-slanted straight panel (K-L), and is configured to improve immobilization of the genitalia of the male human wearer and enables fabric, on two sides of the front-side pouch (231), to cling to a body of the male human wearer and prevents the boxers underwear (100) from being loose and provides a tailored fit of the boxers underwear (100);

wherein a right-side contour edge (C-D) of said boxers underwear (100) is entirely straight and entirely non-curved;

wherein a left-side contour edge (A-B0 of said boxers underwear (100) is entirely straight and entirely non-curved.

2. The boxers underwear of claim 1, wherein the front-side pouch (231) prevents rubbing of (i) a testicle of the male human wearer, against (ii) a hip of the male human wearer.

3. The boxers underwear of claim 1, wherein the front-side pouch (231) is non-pear-shaped.

4. The boxers underwear of claim 1, wherein the front-side pouch (231) has horizontal symmetry and vertical a-symmetry.

* * * * *